US011705658B2

(12) United States Patent
Folger et al.

(10) Patent No.: US 11,705,658 B2
(45) Date of Patent: Jul. 18, 2023

(54) TWIST-LOCK ELECTRICAL CONNECTOR ASSEMBLY

(71) Applicant: APTIV TECHNOLOGIES LIMITED, St. Michael (BB)

(72) Inventors: Tyler Folger, Warren, RI (US); David Barros Martins, Fall River, MA (US); Marco M. Lucci, Cranston, RI (US); William C. Falk, Warwick, RI (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 17/484,016

(22) Filed: Sep. 24, 2021

(65) Prior Publication Data

US 2022/0109261 A1 Apr. 7, 2022

Related U.S. Application Data

(60) Provisional application No. 63/086,893, filed on Oct. 2, 2020.

(51) Int. Cl.

| | |
|---|---|
| ***H01R 13/22*** | (2006.01) |
| ***H01R 4/18*** | (2006.01) |
| ***H01R 13/115*** | (2006.01) |

(52) U.S. Cl.

CPC ..... *H01R 13/22* (2013.01); *H01R 4/184* (2013.01); *H01R 13/115* (2013.01); *H01R 2201/26* (2013.01); *Y10S 439/936* (2013.01)

(58) Field of Classification Search

CPC ..... H01R 11/282; H01R 11/11; H01R 11/01; H01R 4/28; H01R 13/2457; H01R 13/115; H01R 13/14; H01R 13/052; H01R 4/184; H01R 11/12; H01R 13/22

See application file for complete search history.

(56) References Cited

U.S. PATENT DOCUMENTS

| | | | | |
|---|---|---|---|---|
| 2,787,693 | A * | 4/1957 | Razlag | H01R 24/66 338/322 |
| 3,514,740 | A * | 5/1970 | Filson | H01R 13/115 403/285 |
| 5,897,406 | A * | 4/1999 | Benes | H01R 11/22 439/859 |
| 6,039,616 | A | 3/2000 | Pereira et al. | |
| 6,249,966 | B1 | 6/2001 | Pereira et al. | |
| 6,475,043 | B2 | 11/2002 | Pereira et al. | |
| 6,520,812 | B1 | 2/2003 | Machado | |
| 6,599,156 | B2 | 7/2003 | Pereira et al. | |
| 6,599,157 | B2 | 7/2003 | Pereira et al. | |
| 6,607,409 | B2 | 8/2003 | Machado | |
| 6,676,455 | B2 | 1/2004 | Machado | |
| 6,780,071 | B2 | 8/2004 | Pereira et al. | |
| 6,945,831 | B2 | 9/2005 | Pereira et al. | |
| 7,083,481 | B2 | 8/2006 | Pereira et al. | |

(Continued)

*Primary Examiner* — Briggitte R. Hammond
(74) *Attorney, Agent, or Firm* — Billion & Armitage

(57) ABSTRACT

An electrical connector assembly includes a male terminal having a first pivot feature and a plurality of contact arms extending from the first pivot feature. The assembly further includes a female terminal having a base plate defining a second pivot feature and a plurality of receptacle features configured to receive free ends of the plurality of contact arms as the first pivot feature engages the second pivot feature and the plurality of contact arms is rotated around the first and second pivot features.

14 Claims, 4 Drawing Sheets

(56) References Cited

U.S. PATENT DOCUMENTS

| | | | | |
|---|---|---|---|---|
| 7,160,157 | B1 * | 1/2007 | Jones, III ..... | H01R 11/01<br>439/288 |
| 7,226,299 | B2 | 6/2007 | Pereira et al. | |
| 7,371,083 | B2 | 5/2008 | Pereira et al. | |
| 7,553,204 | B2 | 6/2009 | Pereira et al. | |

* cited by examiner

TWIST-LOCK ELECTRICAL CONNECTOR ASSEMBLY

CROSS-REFERENCE TO RELATED APPLICATION

This application claims the benefit of priority to U.S. Provisional Patent Application No. 63/086,893, filed Oct. 2, 2020, the entire disclosure of which is hereby incorporated by reference.

BACKGROUND

Electrically conductive traces are formed on or within the windows of vehicle to form electrical circuits, such as antennas or defrosters. To electrically connect the conductive traces to an associated electronic device, an electrical terminal, usually a male terminal, is soldered to the glass in communication with the conductive trace. A female terminal at the end of a cable connected to the associated electronic device is then mated with the male terminal located on the glass.

In some applications, the male terminal has a male circular post and the mating female terminal may have a cup shaped female socket having resilient contact tabs that engage the post. The contact tabs are bent inwardly into the socket for resilient engagement. The cup shaped socket of the female terminal is crimped to a conductor within the cable. Such a female socket is often used for low power applications such as antennas but is not suitable for devices such as rear window defrosters which require higher power.

SUMMARY

According to one or more aspects of the present disclosure, an electrical connector assembly includes a male terminal having a first pivot feature and a plurality of contact arms extending from the first pivot feature. The electrical connector assembly also includes a female terminal having a base plate defining a second pivot feature and a plurality of receptacle features configured to receive free ends of the plurality of contact arms as the first pivot feature engages the second pivot feature and the plurality of contact arms is rotated around the first and second pivot features.

In one or more embodiments of the electrical connector assembly according to the previous paragraph, the first pivot feature may be a circular indentation and the second pivot feature is a circular protrusion received within the circular indentation.

In one or more embodiments of the electrical connector assembly according to any one of the previous paragraphs, the circular indentation may be formed by a circular aperture extending through the male terminal.

In one or more embodiments of the electrical connector assembly according to any one of the previous paragraphs, the first pivot feature may be formed by an embossment in the form of a hollow spherical sector.

In one or more embodiments of the electrical connector assembly according to any one of the previous paragraphs, the plurality of receptacle features may define U-shaped gaps in which the free ends are received.

In one or more embodiments of the electrical connector assembly according to any one of the previous paragraphs, each arm in the plurality of contact arms may be offset by an angle of less than 180 degrees from an adjoining arm in the plurality of contact arms.

In one or more embodiments of the electrical connector assembly according to any one of the previous paragraphs, each arm in the plurality of contact arms may be offset by an angle of about 150 degrees from the adjoining arm in the plurality of contact arms.

In one or more embodiments of the electrical connector assembly according to any one of the previous paragraphs, the plurality of contact arms defines stop features may extend perpendicularly from the plurality of contact arms and proximate the free ends and the stop features may be configured to engage the plurality of receptacle features as the plurality of contact arms is rotated around the first and second pivot features, thereby limiting further rotation.

In one or more embodiments of the electrical connector assembly according to any one of the previous paragraphs, the plurality of contact arms may define contact projections extending proximate the free ends and configured to contact the plurality of receptacle features.

In one or more embodiments of the electrical connector assembly according to any one of the previous paragraphs, the contact projections may be formed by embossments in the form of spherical sectors.

In one or more embodiments of the electrical connector assembly according to any one of the previous paragraphs, the plurality of receptacle features may define contact indentations configured to receive the contact projections.

In one or more embodiments of the electrical connector assembly according to any one of the previous paragraphs, the contact indentations may be formed by circular apertures extending through the plurality of receptacle features.

In one or more embodiments of the electrical connector assembly according to any one of the previous paragraphs, the contact indentations may be formed by embossments in the form of a hollow spherical sectors.

In one or more embodiments of the electrical connector assembly according to any one of the previous paragraphs, the base plate may be substantially planar and circular around the second pivot feature.

In one or more embodiments of the electrical connector assembly according to any one of the previous paragraphs, the plurality of receptacle features may be J-shaped tabs extending from an edge of the base plate.

In one or more embodiments of the electrical connector assembly according to any one of the previous paragraphs, the male terminal may further include a wire attachment portion extending from the first pivot feature.

In one or more embodiments of the electrical connector assembly according to any one of the previous paragraphs, the plurality of contact arms may consist of two arms.

In one or more embodiments of the electrical connector assembly according to any one of the previous paragraphs, the base plate may include a layer of solder on a surface opposite the second pivot feature.

According to one or more aspects of the present disclosure, a male electrical terminal includes a pivot feature. The pivot feature is a circular indentation. The male electrical terminal further includes a plurality of contact arms extending from the pivot feature. Each arm in the plurality of contact arms is offset by an angle of about 150 degrees from the adjoining arm in the plurality of contact arms.

According to one or more aspects of the present disclosure, a female electrical terminal includes a base plate defining a pivot feature. The pivot feature is a circular protrusion formed by an embossment in the form of a spherical sector. The base plate is substantially planar and circular. The pivot feature is in the center of the base plate.

The female electrical terminal additionally includes a plurality of receptacle features defining U-shaped gaps.

DETAILED DESCRIPTION

A low-profile electrical connector assembly in which a male terminal is locked into a female terminal by twisting a pivot point on the male terminal around a mating pivot point on the female terminal is presented herein. The male terminal has contact arms extending from its pivot point that are received in receptacles of the female terminal as the male terminal is twisted about the pivot points, thus locking the male terminal to the female terminal. The electrical connector assembly is particularly suited for making high current electrical connections between a wire attached to the male terminal and an on-glass conductive trace to which the female terminal is soldered, such as those used in automotive window defroster circuits.

Figure 1D:
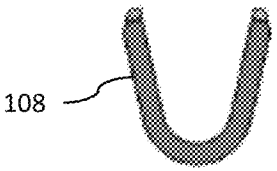
FIG. 1*d* is a cross section view of the flat electrical conductor of the male electrical connector along the section line 1*d*-1*d* of FIG. 1*a* according to some embodiments.
Figure 1C:
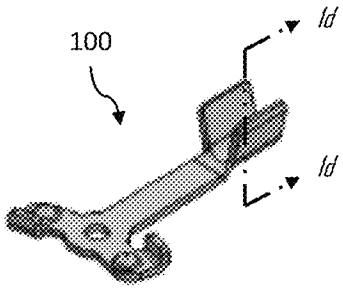
FIG. 1*c* is a perspective view of the male electrical connector of FIG. 1*a* according to some embodiments.
Figure 1A:
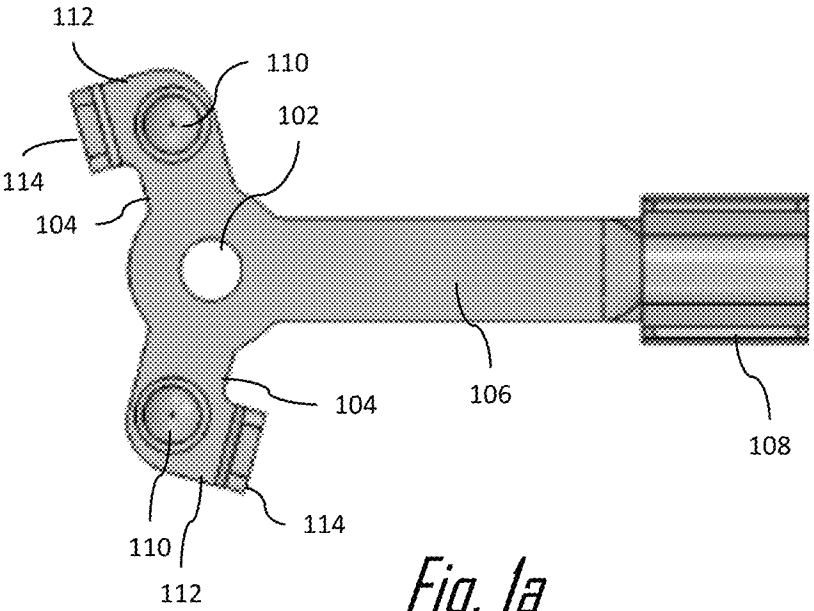
FIG. 1*a* is a top view of a male electrical connector according to a first embodiment.
Figure 1B:
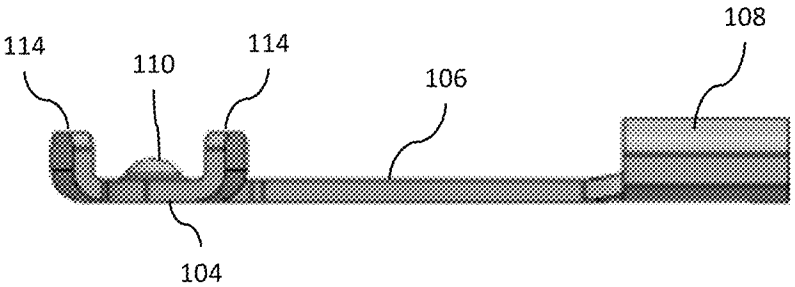
FIG. 1*b* is a side view of the male electrical connector of FIG. 1*a* according to some embodiments.
Figure 3A:
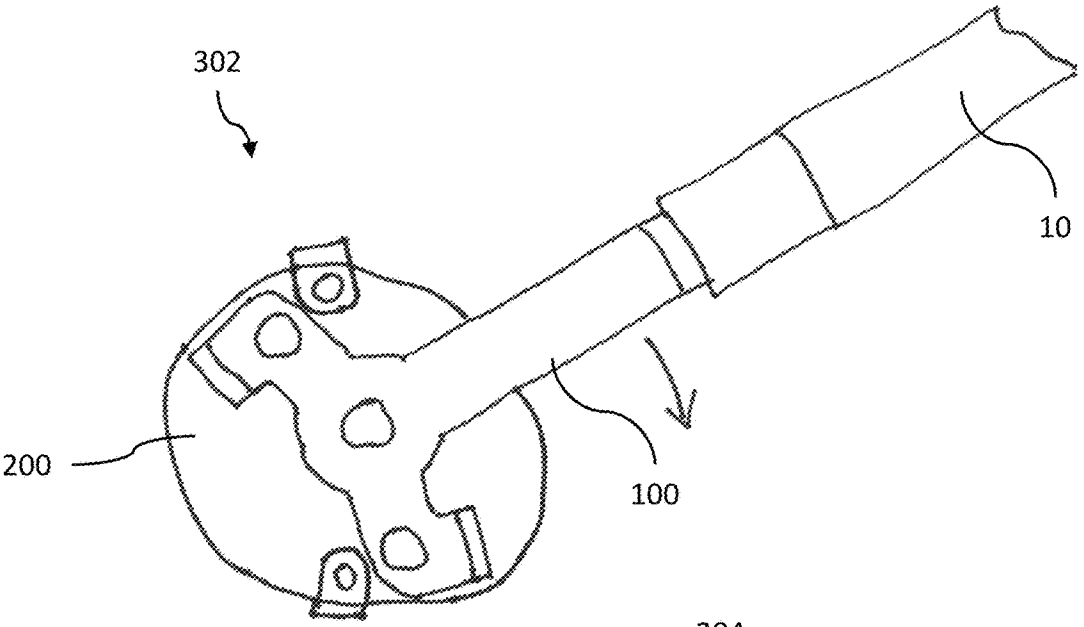
FIG. 3*a* is a top view of the male electrical connector of FIG. 1*a* in a pre-engaged position and the female electrical connector of FIG. 2*a* according to some embodiments.
Figure 3B:
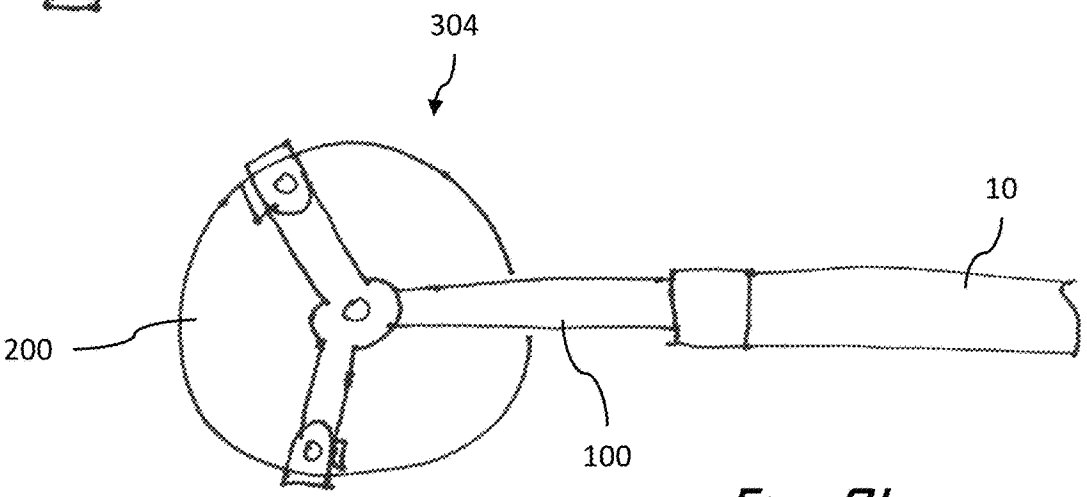
FIG. 3*b* is a top view of the male electrical connector of FIG. 1*a* rotated to an engaged position and the female electrical connector of FIG. 2*a* according to some embodiments.
Figure 4C:
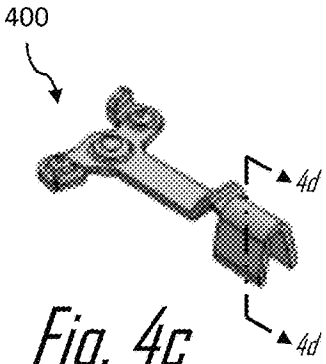
FIG. 4*c* is a perspective view of the male electrical connector of FIG. 4*a* according to some embodiments.
Figure 4D:
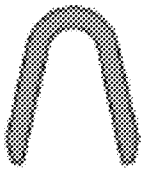
FIG. 4*d* is a cross section view of the flat electrical conductor of the male electrical connector along the section line 4*d*-4*d* of FIG. 4*c* according to some embodiments.
Figure 4A:
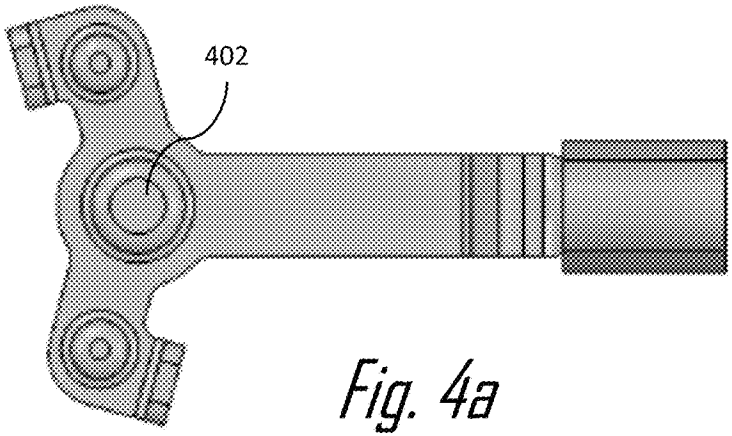
FIG. 4*a* is a top view of a male electrical connector according to some embodiments.
Figure 4B:
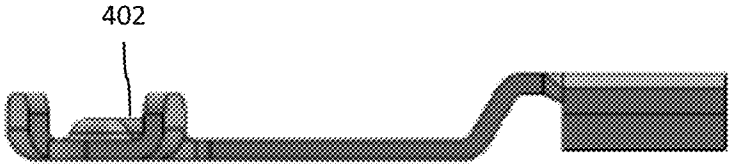
FIG. 4*b* is a side view of the male electrical connector of FIG. 4*a* according to some embodiments.

FIGS. 1*a*-1*d* illustrate a non-limiting example of a male electrical terminal 100 of the electrical connector assembly. The male terminal 100 has a first pivot feature 102 and a pair of contact arms 104 extending from the first pivot feature 102. The male terminal 100 also includes a wire attachment portion 106 extending from the first pivot feature 102. The wire attachment portion 106 has a pair of crimp wings 108 that are configured to attach the male terminal 100 to a wire electrical cable 10 as shown in FIGS. 3*a*-3*b*. The first pivot feature 102 shown in FIGS. 1*a*-1*c* is a circular aperture extending though the male terminal 100. The pair of contact arms 104 extend from the first pivot feature 102 at an angle of about 105 degrees from the centerline of the wire attachment portion 106 and 150 degrees from each other. The contact arms 104 define contact projections 110 extending from a location near the free ends 112 of the contact arms 104. The contact projections 110 have a spherical sector shape that is less than or equal to a hemisphere. The contact arms 104 also define stop features 114 extending perpendicularly from the contact arms 104 and located proximate the free ends 112 of the contact arms 104. The stop feature 114 on one contact arm 104 is located on an opposite side of the stop feature 114 of the other contact arm 104. The male terminal 100 may be formed from a sheet of metal, e.g., a tin-plated copper sheet, by stamping, punching, blanking, bending, and embossing methods well known to those skilled in the art.

Figure 2A:
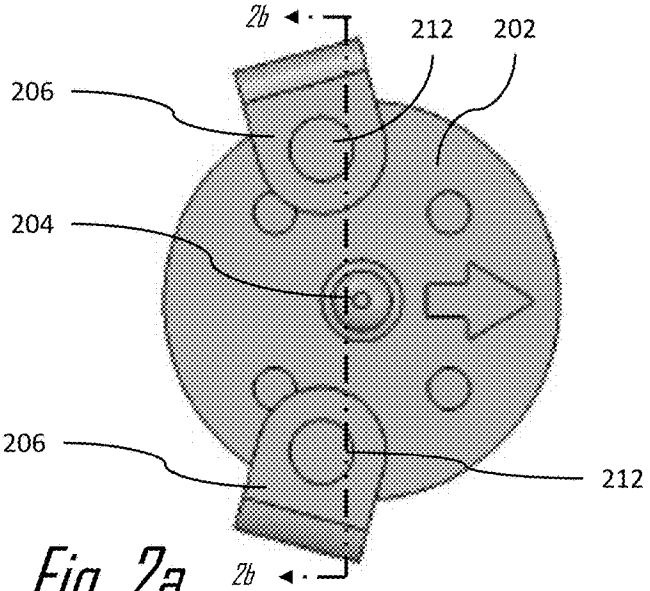
FIG. 2*a* is a top view of a female electrical connector according to some embodiments.
Figure 2B:
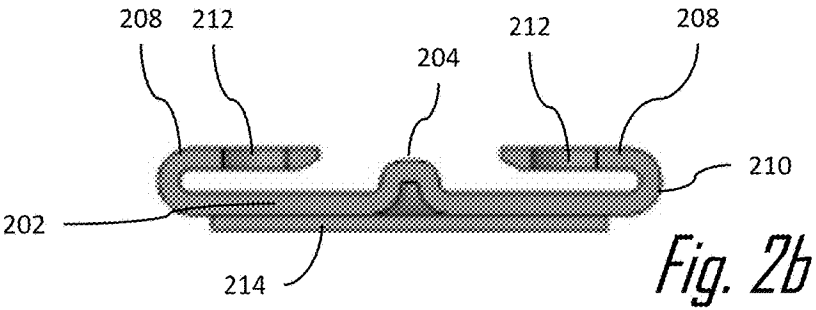
FIG. 2*b* is a cross-section side view of the female electrical connector of FIG. 2*a* along the section line 2*b*-2*b* of FIG. 2*a* according to some embodiments.
Figure 2C:
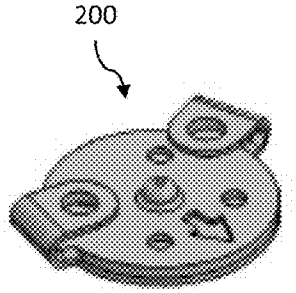
FIG. 2*c* is a perspective view of the female electrical connector of FIG. 2*a* according to some embodiments.

FIGS. 2*a*-2*c* illustrate a non-limiting example of a female electrical terminal 200 of the electrical connector assembly. The female terminal 200 has a base plate 202 that defines a second pivot features 204 that is configured to mate with the first pivot feature 102 of the male terminal 100 and allow the male terminal 100 to pivot around the second pivot feature 204. The female terminal 200 also includes a pair of receptacle features 206 that are configured to receive the free ends 112 of the contact arms 104 as the first pivot feature 102 engages the second pivot feature 204 and the contact arms 104 are twisted or rotated around the first and second pivot features, 102, 204. The base plate 202 has a generally planar and circular shape. The second pivot feature 204 projects from the base plate 202 and has a spherical sector shape that is less than or equal to a hemisphere. The receptacle features 206 are in the form of J-shaped tabs 208 extending from the edges of the base plate 202. The tabs 208 form a gap 210 with the base plate 202 in which the free ends 112 of the contact arms 104 are received. The tabs 208 define contact indentations 212 that are configured to receive the contact projections 110. The contact indentations 212 are formed by circular apertures extending through the tabs 208. The base plate 202 also includes a layer of solder 214 on the side of the base plate 202 opposite the second pivot feature 204 that is used to attach the female terminal 200 to a conductive trace, e.g. a defroster circuit on an automotive glass window (not shown). The female terminal 200 may be formed from a sheet of metal, e.g., a tin-plated copper sheet, by stamping, punching, blanking, bending, and embossing methods well known to those skilled in the art. This combination of male terminal 100 and female terminal 200 provide the benefits of higher current carrying capability than the prior post and cup sockets and so may be used in higher current applications, such as window defrosters.

FIGS. 3*a*-3*b* show the process of connecting the male terminal 100 to the female terminal 200. In the disengaged position 302 shown in FIG. 3*a*, the second pivot feature 204 of the female terminal 200 is received within the first pivot feature 102 of the male terminal 100 while the free ends 112 of the contact arms 104 are offset from the receptacle features 206. The male terminal 100 is then rotated in a clockwise direction relative to the female terminal 200 to the engaged position 304 shown in FIG. 3*b* where the contact projections 110 on the contact arms 104 are disposed within the contact indentations 212 of the receptacle features 206 and the stop features 114 are in contact or engaged with the receptacle feature 206, thereby inhibiting further rotation of the male terminal 100. As the contact arms 104 are rotated, the contact projections 110 will make contact with the tabs 208 and push them outwardly until the contact projections 110 are seated within the contact indentations 212 at which point the tabs 208 will flex inwardly return to their original position. The contact arms 104, contact projections 110, tabs 208, and contact indentations 212 are sized, shaped, and arranged to produce a normal force between the male and female terminals when in the engaged position of FIG. 3*b*.

The engagement of the contact projections 110 with the contact indentations 212 and the contact of the stop features 114 with the receptacle features 206 provides tactile feedback to an assembler that the male terminal 100 is fully engaged and electrically connected with the female terminal 200.

An alternative embodiment of the male terminal 400 is shown in FIGS. 4*a*-4*d* in which the first pivot feature 402 is in the form of a hollow spherical sector. Other alternative embodiments of the electrical connector assembly may be envisioned in which the male terminal is rotated counter-clockwise relative to the female terminal, the first pivot feature is received within the second pivot feature, the second pivot feature has a cylindrical shape, or the contact arms define spring features to engage the receptacle feature. Yet other embodiments may be envisioned for use with printed circuit boards or including a mounting stud protecting from the base plate of the female terminal.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention is not limited to the disclosed embodiment(s), but that the invention will include all embodiments falling within the scope of the appended claims.

The invention claimed is:

1. An electrical connector assembly, comprising:

a male terminal having a first pivot feature and a plurality of contact arms extending from the first pivot feature; and a female terminal having a base plate defining a second pivot feature and a plurality of receptacle features configured to receive free ends of the plurality of contact arms as the first pivot feature engages the second pivot feature and the plurality of contact arms is rotated around the first and second pivot features, wherein the plurality of contact arms defines contact projections extending proximate the free ends and configured to contact the plurality of receptacle features, and wherein the plurality of receptacle features defines contact indentations configured to receive the contact projections.

2. The electrical connector assembly according to claim 1, wherein the first pivot feature is a circular indentation and the second pivot feature is a circular protrusion received within the circular indentation and wherein the circular indentation is formed by a circular aperture extending through the male terminal.

3. The electrical connector assembly according to claim 1, wherein the plurality of receptacle features defines U-shaped gaps in which the free ends are received.

4. The electrical connector assembly according to claim 1, wherein the plurality of contact arms defines stop features extending perpendicularly from the plurality of contact arms and proximate the free ends and wherein the stop features are configured to engage the plurality of receptacle features as the plurality of contact arms is rotated around the first and second pivot features, thereby limiting further rotation.

5. The electrical connector assembly according to claim 1, wherein the contact indentations are formed by circular apertures extending through the plurality of receptacle features.

6. The electrical connector assembly according to claim 1, wherein the contact indentations are formed by embossments in the form of a hollow spherical sectors.

7. The electrical connector assembly according to claim 1, wherein the base plate is substantially planar and circular around the second pivot feature.

8. The electrical connector assembly according to claim 1, wherein the male terminal further includes a wire attachment portion extending from the first pivot feature.

9. The electrical connector assembly according to claim 1, wherein the plurality of contact arms consists of two arms.

10. The electrical connector assembly according to claim 1, wherein the base plate includes a layer of solder on a surface opposite the second pivot feature.

11. The electrical connector assembly according to claim 1, wherein each arm in the plurality of contact arms is offset by an angle of less than 180 degrees from an adjoining arm in the plurality of contact arms.

12. The electrical connector assembly according to claim 11, wherein each arm in the plurality of contact arms is offset by an angle of about 150 degrees from the adjoining arm in the plurality of contact arms.

13. An electrical connector assembly, comprising:

a male terminal having a first pivot feature and a plurality of contact arms extending from the first pivot feature; and a female terminal having a base plate defining a second pivot feature and a plurality of receptacle features configured to receive free ends of the plurality of contact arms as the first pivot feature engages the second pivot feature and the plurality of contact arms is rotated around the first and second pivot features, wherein the plurality of contact arms defines contact projections extending proximate the free ends and configured to contact the plurality of receptacle features and wherein the contact projections are formed by embossments in the form of spherical sectors.

14. An electrical connector assembly, comprising:

a male terminal having a first pivot feature and a plurality of contact arms extending from the first pivot feature; and a female terminal having a base plate defining a second pivot feature and a plurality of receptacle features configured to receive free ends of the plurality of contact arms as the first pivot feature engages the second pivot feature and the plurality of contact arms is rotated around the first and second pivot features, wherein the plurality of receptacle features are J-shaped tabs extending from an edge of the base plate.

* * * * *